United States Patent [19]

Takanashi et al.

[11] 4,379,980

[45] Apr. 12, 1983

[54] QUICK OPERATING CATHODE

[75] Inventors: Yukio Takanashi, Hiratsuka; Tooru Yakabe, Yokohama; Shunji Asano, Kawasaki, all of Japan

[73] Assignee: Tokyo Shibaura Denki Kabushiki Kaisha, Kawasaki, Japan

[21] Appl. No.: 255,637

[22] Filed: Apr. 20, 1981

[30] Foreign Application Priority Data

Apr. 21, 1980 [JP] Japan ..... 55-51705

[51] Int. Cl.[3] ..... H01J 1/22; H01J 1/20; H01J 29/04

[52] U.S. Cl. ..... 313/446

[58] Field of Search .... 313/446, 340, 337 (U.S. only), 313/344 (U.S. only), 345 (U.S. only)

[56] References Cited

FOREIGN PATENT DOCUMENTS 53-100868 8/1978 Japan .

54-27230 9/1979 Japan .

*Primary Examiner*—Robert Segal

*Attorney, Agent, or Firm*—Cushman, Darby & Cushman

[57] ABSTRACT

A quick operating type cathode having a cathode body consisting of: a cathode sleeve and a metal substrate which is mounted at the top opening part of the cathode sleeve and the top surface of which is coated with an electron-emissive material; and a double helical coil heater which is inserted within the cathode sleeve and the surface of which is coated with an insulating material, is characterized in that said heater comprises a coil part and a pair of leg parts connected to the end part of said coil part, a dense pitch part is formed at the top of said coil part, a sparse pitch part is formed in said coil part at the side of the leg parts and the amount of said coated insulating material per unit length of the coil wire at said sparse pitch part is larger than that at said dense pitch part.

6 Claims, 9 Drawing Figures

QUICK OPERATING CATHODE

BACKGROUND OF THE INVENTION

The present invention relates to a cathode for an electron gun and, more particularly, to a quick operating type cathode for an electron gun of a cathode-ray tube.

In order to project an image on the screen of a television receiver as fast as possible and quickly stabilize the image projected on the screen, it is neccessary to adopt a quick operating type cathode as the cathode of an electron gun.

An example of a conventional quick operating type cathode will be described, together with the related structures, referring to FIG. 1.

A quick operating type cathode comprises a cathode body 5 consisting of a cathode sleeve 6 arranged in opposition to a first grid 1 supported by a first grid holding strap 2, and a metal substrate 7 coated with an electron-emissive material on a surface which opposes the first grid 1; a cathode body support cylinder 8 for supporting the cathode body 5 from, for example, three directions, through a support bar 9; a cathode holding strap 4 fixed to the cathode body support cylinder 8 through a cathode support 3; and a heater 13 supported by a heater strap 10 through a heater support plate 12. The straps 2, 4 and 10 are fixed at equal intervals by a pair of insulating support rods 11. The insulating support rods 11 are fixed to a stem 14 by support members.

A quick operating type cathode of this construction is assembled in an electron gun assembly, this electron gun assembly is sealed within a bulb, the bulb is evacuated, and aging is performed to complete a cathode-ray tube. The time required for an image to be projected on the screen from the time the switch of a sufficiently cooled television set provided with the cathode-ray tube is turned on is referred to as the image projecting time. This image projecting time is 4 to 4.5 seconds in a general rapid operating cathode-ray tube which assembles the cathode shown in FIG. 1 and which is sufficiently activated. However, such an image projecting time is not satisfactory. A cathode which further shortens the image projecting time will be described with reference to FIG. 2.

In the cathode shown in FIG. 2, the length of a cathode sleeve 16 is 1.5 times that of the cathode sleeve 6 of the cathode shown in FIG. 1. The cathode sleeve 16 is mounted to the cathode support cylinder 8 through a support bar 17. A coil part 18*a* of a double helical heater 18 is made shorter than the length of the cathode sleeve 16. With a cathode of this construction, since the heat generating part (coil part) 18*a* of the heater 18 is housed within the cathode sleeve 16, the heat efficiency is good. This results in an advantage in that the rate at which the temperature of the electron-emissive portion rises after the switch is turned on is faster than with the cathode shown in FIG. 1. The image projecting time may be shortened to about 2.7 seconds with this cathode.

However, with the cathode of the construction shown in FIG. 2, the outer diameter of a shoulder part 18*c* of the double helical coil necessarily becomes larger than that of the coil part 18*a*. For this reason, the shoulder part 18*c* and the inner wall of the cathode sleeve 16 tend to be abnormally close to each other, frequently degrading the voltage resistance between the heater and the cathode body. In general, with the heater 18, alumina is coated as an insulating material on the surface of a tungsten-rhenium alloy wire. This alumina generally contains about 0.1% of an alkali component, $Na_2O$. This alkali component is eliminated by evaporation by applying an excessive heater voltage to the heater during the aging process in the manufacture of the cathode-ray tube. However, with the cathode of the construction shown in FIG. 2, the alkali component evaporated from the heat generating part 18*a* at a high temperature is deposited on parts of the heater 18 at lower temperatures, i.e., leg parts 18*d*, the shoulder part 18*c*, and a final-turn part 18*b*. The deposition of the alkali component near the heater shoulder part 18*c*, and the abnormal closeness of the shoulder part 18*c* to the cathode sleeve 16, cause dielectric breakdown between the heater and the cathode body. When such a dielectric breakdown occurs, the heater potential interferes with the cathode potential, causing distortion of the image formed on the screen of the cathode-ray tube. When the dielectric breakdown is extreme, it may even cause disconnection of the heater.

A cathode as shown in FIG. 3 is conceivable as a quick operating type cathode which eliminates the defects of the cathode shown in FIG. 2. In the quick operating type cathode shown in FIG. 3, a heat generating part 19*a* is elongated so that the low-temperature parts of a heater 19, i.e., a final-turn part 19*b*, a shoulder part 19*c*, and leg parts 19*d*, are outside the cathode sleeve 16. For this reason, the defects of the cathode as shown in FIG. 2 are eliminated. However, with a cathode of such a construction, immediately after a voltage is applied to the heater, the temperature in the vicinity of the final-turn part 19*b* of the heater 19 is elevated first, and the temperature is then elevated at subsequent upper parts of the coil. This results in a disadvantage in that the elevation of the temperature of the cathode body, particularly in the metal substrate 7, is delayed. For example, the image projecting time of a television set which has assembled a cathode of the construction shown in FIG. 3 was found to be 3.2 seconds. There are other reasons for this delay in the image projecting time. For example, when the insulating material such as alumina is coated on the coil by the spray method, the insulating material is only thinly coated for 2 to 3 turns near the final-turn part 19*b*, but is coated thickly at parts closer to the turning point of the coil, i.e., closer to the metal substrate. To be more specific, the insulating material is sprayed onto the coil, with the edge portions, i.e., leg parts, of a numbers of coils arranged in series held by an instrument called "spray chuck." Thus, the spray stream is curved near the leg parts of the coil because of the presence of the spray chuck, leading to the above-noted difficulty.

SUMMARY OF THE INVENTION

It is an object of the present invention to provide a quick operating type cathode according to which the image projecting time is short and which operates extremely stably over a long period of time.

According to the present invention, there is provided a quick operating type cathode having a cathode body consisting of: a cathode sleeve and a metal substrate which is mounted at the top opening part of the cathode sleeve and the top surface of which is coated with an electron-emissive material; and a double helical coil heater which is inserted within the cathode sleeve and the surface of which is coated with an insulating material, characterized in that said heater comprises a coil part and a pair of leg parts connected to the end part of said coil part, a dense pitch part is formed at the top portion of said coil part, a sparse pitch part is formed in said coil part at the side of the leg parts and the amount of said coated insulating material per unit length of the coil wire at said sparse pitch part is larger than that at said dense pitch part.

DETAILED DESCRIPTION OF THE PREFERRED EMBODIMENTS

A quick operating type cathode according to an embodiment of the present invention will now be described with reference to FIG. 4.

Figure 1:
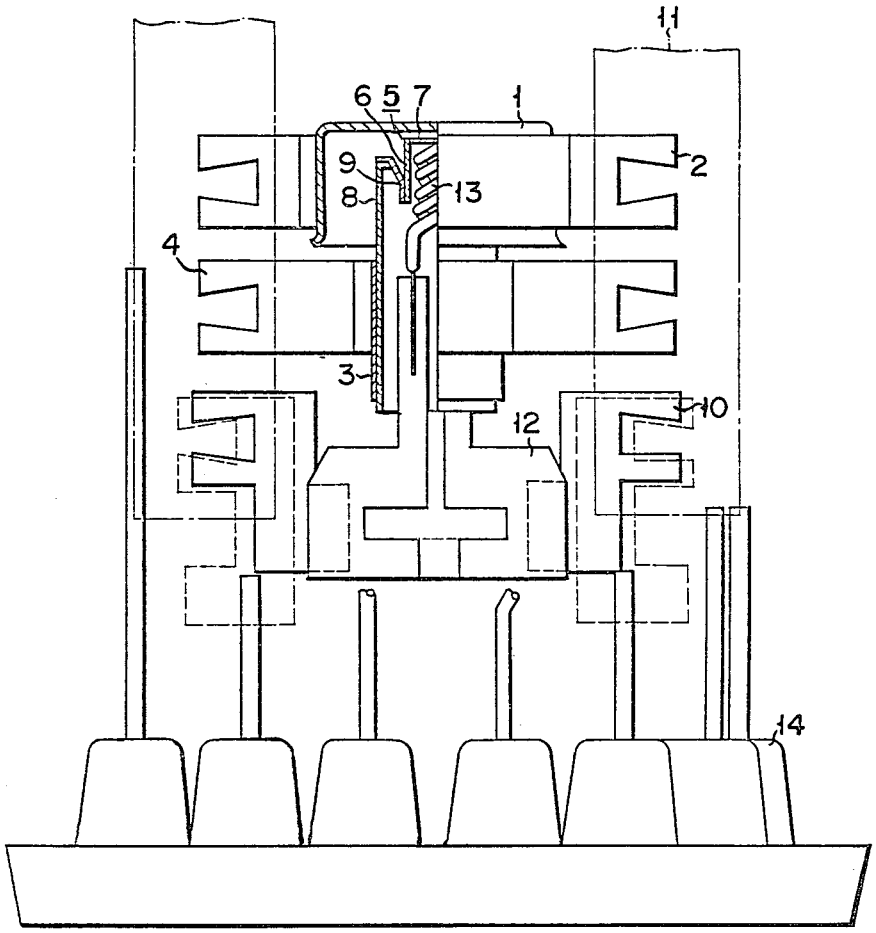
FIG. 1 PRIOR ART
FIG. 1 is a partial sectional view of a conventional quick operating type cathode and its related structures.
Figure 4:
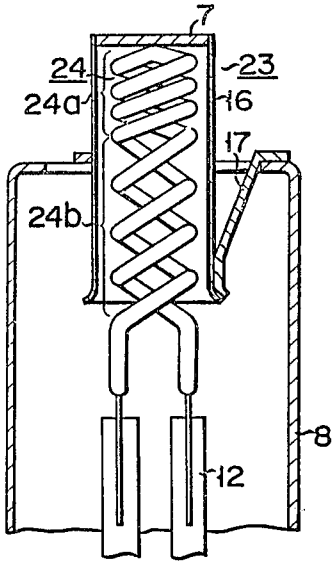
FIG. 4 is a sectional view of a quick operating type cathode according to an embodiment of the present invention.

Referring to FIG. 4, the quick operating type cathode comprises a cathode body 23 and a heater 24. The cathode body 23 comprises a cathode sleeve 16 and a metal substrate 7 arranged at the top of the cathode sleeve 16. An electron-emissive material (not shown) is coated on the top surface of the metal substrate 7. The heater 24 is inserted in the cathode sleeve 16 and is supported at its lower end by a heater support plate 12. The cathode sleeve 16 is supported by a cathode body support cylinder 8 through, for example, three support bars 17. In this case, in a color picture tube, the heaters of three cathodes mounted to three electron guns are connected in series through the heater support plates, respectively.

The heater 24 comprises a double helical coil and leg parts. The coil part consists of a dense pitch part 24*a* and a sparse pitch part 24*b*, and the length of the coil part is made longer than that of the cathode sleeve 16.

The cathode sleeve 16 is a hollow cylinder made of a Ni alloy consisting of, for example, 76% by weight of Ni, 20% by weight of Cr, and 4% by weight of W. The thickness of the sleeve 16 is 18 μm, the outer diameter is 1.39 mm, and the length is 3.2 mm. Into the top part of the cathode sleeve 16 is pressed and welded the metal substrate 7 consisting of a disk of 100 μm thickness consisting of Ni containing small amounts of Mg and Si. At the end (three locations) of the cathode sleeve 16 opposite to the metal substrate mounting side are mounted the support bars 17 of invar steel (Ni:36%). The cathode sleeve 16 is mounted to the top of the cathode body support cylinder by these support bars 17. The top surface of the metal substrate 7 is coated with BaSrCa ($CO_3$) as the electron-emissive material.

In the heater 24, a tungsten wire of 0.05 mm diameter, 31 mm length, and containing 3% by weight of rhenium is wound to provide a double helical coil of 0.86 mm outer diameter and 3.40 mm length whose surface is coated by the spray method which alumina as the insulating material. The coil part of the heater 24 is wound at different pitches at its upper and lower parts so that there are 1.75 turns at 0.55 mm pitch at the dense pitch part 24*a* and 2 turns at 1.10 mm pitch at the sparse pitch part 24*b*. The pitch at the sparse part is generally 1.5 to 6 times that at the dense pitch part. The thermal irradiation of the heater may be improved by forming a blacking layer containing tungsten powder or the like at the surface of of the alumina layer or between the alumina layer and the surface of the coil. It is necessary to coat the alumina layer more thinly at the dense pitch part than at the sparse pitch part by controlling the direction and the spray rate of the spray gun. Since the dense pitch part is near the top of the heater and the sparse pitch part is at the side of the leg parts in the heater according to the present invention, the coated amount of alumina can be easily controlled by appropriate operation of the spray gun. Although the reason for this not clear, it is thought to be related to the fact that the flow of spray easily passes through the sparse pitch part so that the alumina is easily coated on the interior of the coil, that is, around the heater wire constituting the coil.

Three heaters 24 of this construction are assembled as connected in series with the three electron guns of a color picture tube, and operate normally at a heater voltage of 6.3 V and a heater current of 450 mA, that is, 2.1 V and 450 mA for each.

Figure 3:
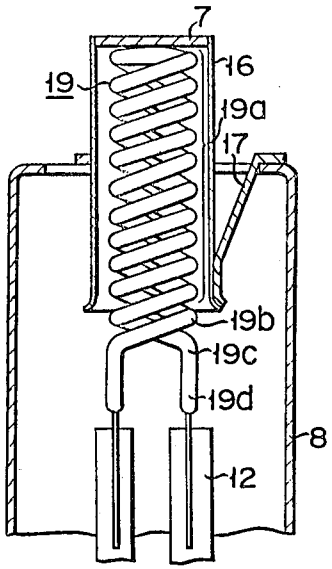
FIG. 3 PRIOR ART
FIGS. 2 and 3 are sectional views of the main parts of other conventional quick operating type cathodes.
Figure 2:
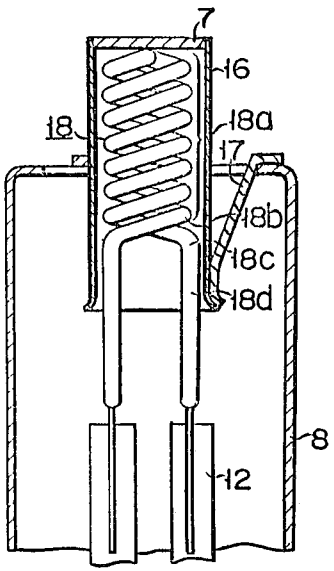
FIG. 2 PRIOR ART
Figure 5:
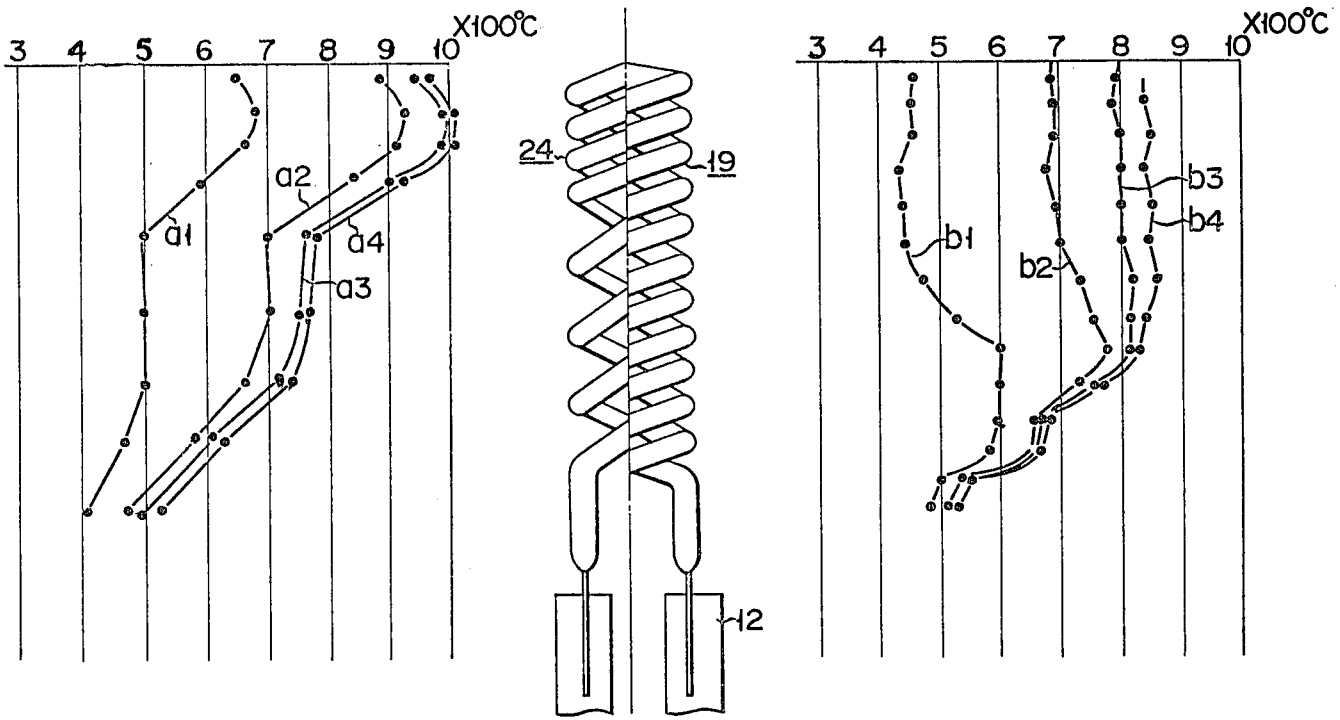
FIG. 5 presents graphs comparing the temperature distributions of the heaters of the cathode of the present invention and of a conventional cathode.

The patterns of temperature elevation at each part of the heaters after applying a voltage of 2.1 V thereto are shown in FIG. 5 for the heater 24 according to the present invention shown in FIG. 4 and for the conventional heater 19 shown in FIG. 3. Referring to FIG. 5, half of the heater 24 of FIG. 4 and half of the heater 19 of FIG. 3 are shown adjacent to each other at the center. The temperature distribution of the heater 24 is shown at the left, and the temperature distribution of the heater 19 is shown at the right at positions corresponding to the locations within the heaters. In both the right and left graphs, curves $a_1$ and $b_1$ show the temperature distributions at each part of the heater 1 second after applying the heater voltage; curves $a_2$ and $b_2$ show the same after 2 seconds; curves $a_3$ and $b_3$ show the same after 3 seconds; and curves $a_4$ and $b_4$ show the same after 10 seconds. Since these temperature distributions could not be measured while the heaters were inserted in the cathode bodies, they were measured for the exposed condition of the heaters. Thus, although the exact values of the temperatures may be different from those in the case wherein the heater is inserted in the cathode body, the patterns of the temperature distributions are considered to be essentially the same.

As may be apparent from a comparison of the two graphs in FIG. 5, with the double helical coil heater of uniform pitch of the conventional example, the temperature is rapidly elevated at the three turns near the leg parts immediately after the voltage is applied, and the temperature elevation is slow near the top. With a double helical coil heater combining the dense pitch part and the sparse pitch part of the present inveniton, the temperature near the top is quickly raised immediately after the voltage is applied. This is because, with the heater of the present invention, the vicinity of the top part is the dense pitch part and emits a large quantity of heat per unit length of the double helical coil. Further, since the amount of the coated insulating material in the dense pitch part is smaller than that in the sparse pitch part and hence the heat capacity per unit length of the coil wire near the top part is small, the temperature at the vicinity of the top part is quickly elevated. In contrast with this, with the conventional heater, the insulating material is deposited thinly at the leg part side of the coil, as describe above, and the heat capacity of that portion becomes small, so that the temperature near the leg parts is quickly elevated and the temperature at the vicinity of the top part is slowly elevated.

Figure 6:
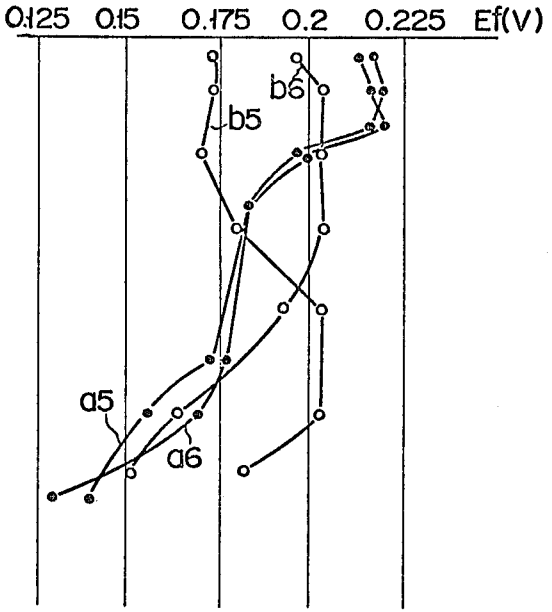
FIG. 6 is a graph comparing the voltage distributions of the heaters of the cathode of the present invention and of a conventional cathode.

As shown in FIG. 5, the rapid elevation of the temperature at the top part of the heater of the present invention is attributable not only to the dense pitch near the top part of the heater and the small amount of coated insulating material there, but also to the fact that the voltage distribution per unit legnth of the heater has a peak near the top part. FIG. 6 shows the voltage Ef per 1 mm of the wire at each part of the conventional heater and the heater of the present invention. In the graph shown in FIG. 6, the ordinate indicates the position for each part of the heater from the leg parts to the top part as in the case of FIG. 5. Referring to the graph in FIG. 6, curves $a_5$ and $a_6$ show the Ef distribution of the heater of the present invention after 1 second and 10 seconds, respectively; and curves $b_5$ and $b_6$ show the Ef distribution of the conventional heater after 1 second and 10 seconds. As may be apparent from the graph in FIG. 6, the Ef of the heater of the present invention after 1 second becomes maximum near the top (dense pitch part) and rapidly drops at the sparse pitch part. This distribution is substantially the same 10 seconds after the voltage is applied. This phenomenon is attributable to the fact that the vicinity of the top of the heater reaches a high temperature since the coil is of dense pitch and the amount of the coated insulating material is small at this part, and the electrical resistance of this part is therefore raised. A high Ef near the top of the heater leads to elevation of the temperature of this part. To the contrary, with the conventional heater, the Ef is higher at the leg parts than at the top part 1 second after voltage application, and the Ef at the top part becomes higher than the Ef at the leg parts 10 seconds after the voltage application. With such a distribution of Ef, power is not effectively used for elevating the temperature of the metal substrate.

Figure 7:
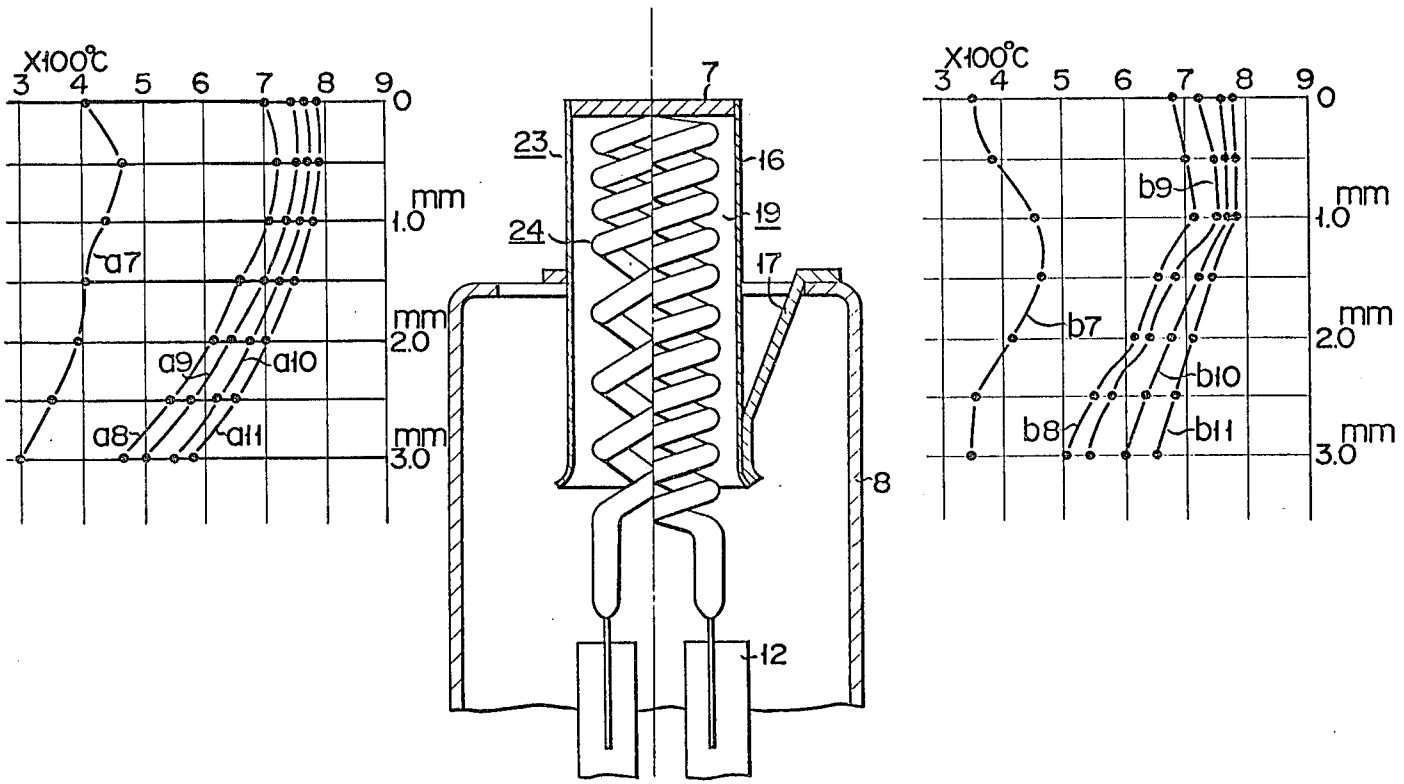
FIG. 7 presents graphs comparing the temperature distributions of the cathode sleeves of the cathode of the present invention and of a conventional cathode.

FIG. 7 shows the temperature distributions at each part of the cathode sleeve 16 when the cathode of the present invention shown in FIG. 4 or the conventional cathode shown in FIG. 3 is inserted in the cathode sleeve 16 of the cathode body 23. The manner in which the heater and the graphs are represented is the same as in FIG. 5. Curves $a_7$, $a_8$, $a_9$, $a_{10}$ and $a_{11}$ in the graph at the left side of FIG. 7 show the temperature distributions of the cathode sleeve of the cathode of the present invention 1 second, 3 seconds, 6 seconds, 10 seconds, and 1 minute, respectively, after applying the voltage. Curves $b_7$, $b_8$, $b_9$, $b_{10}$ and $b_{11}$ in the graph at the right side of FIG. 7 show the temperature distributions of the cathode sleeve of the conventional cathode 1 second, 3 seconds, 6 seconds, 10 seconds, and 1 minute, respectively, after applying the voltage. As may be apparent from a comparison of the two graphs in FIG. 7, with the cathode of the present invention 1 second after applying the voltage, the temperature distribution has a peak at a position 0.5 mm from the top. With the conventional cathode, the temperature distribution has a peak at substantially the center. It is apparent from this that the cathode of the present invention is superior to the conventional cathode as a quick operating type cathode.

The emission of electrons from the electron-emissive material of the cathode is initiated when the temperature of the electron-emissive material becomes 350° C. The time from when the voltage is applied to the heater to when the electrons begin to be emitted from the electron-emissive material is substantially equal to the image projecting time of the television set. The time from application of the voltage to emission of the electrons for the cathode of the present invention in FIG. 4 was 2.5 seconds, whereas that for the conventional cathode shown in FIG. 3 was 3.2 seconds. When experiments were conducted where the cathode shown in FIG. 4 was assembled in a television set, the image projecting time was as short as 2.5 to 2.7 seconds.

A quick operating type cathode according to another embodiment of the present invention will now be described. Since the cathode body is substantially the same as that of the cathode shown in FIG. 4, the description thereof is omitted. Only the description with reference to the heater will be made.

Figure 8:
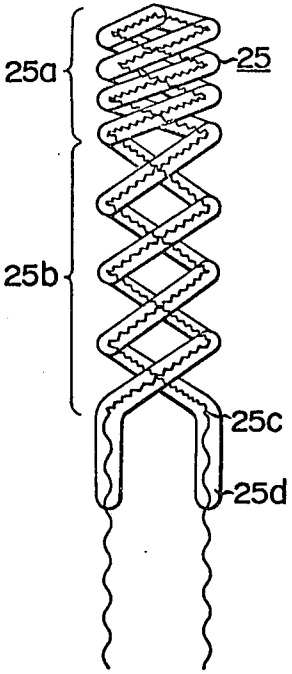
FIG. 8 is a view illustrating the heater of a quick operating type cathode according to another embodiment of the present invention.

FIG. 8 shows a heater 25 consisting of a coiled double helical coil. This heater 25 is obtained by forming a primary coil into a double helical coil, and has, like the heater shown in FIG. 4, a dense pitch part 25*a* and a sparse pitch part 25*b*. This heater 25 is also similar to the heater shown in FIG. 4 in that the insulating material is coated thinly at the dense pitch part 25*a* and thickly at the sparse pitch part 25*b*. Due to the limits imposed by formation into a secondary coil, the pitch of the primary coil is preferably about 150 to 250% the diameter of the wire. However, since such limits are not imposed on a shoulder part 25*c* to leg parts 25*d*, the pitch may be decreased in the sparse pitch part as shown in FIG. 8.

The heater shown in FIG. 8 may, for example, be obtained by preparing a primary coil of 0.074 mm pitch by winding a wire of 0.039 mm diameter and of rhenium-tungsten alloy containing 3% rhenium on a molybdenum wire of 0.073 mm diameter, and forming the primary coil into a secondary coil of 0.86 mm outer diameter. The dense pitch part of the secondary coil has 1.75 turns at 0.55 mm pitch, and the sparse pitch part has 2.0 turns at 1.1 mm pitch. The total length of the dense pitch part and the sparse pitch part is 3.4 mm, and the length of the leg parts is 5 mm. The pitch of the primary coil of the leg parts may be 0.37 mm.

The heater comprising the coiled double helical coil shown in FIG. 8 is particularly preferable as a heater where three such heaters are assembled in parallel for three electron guns of a color picture tube. This heater is also applicable as a quick operating type cathode of a single electron gun for a cathode-ray tube such as a monochrome picture tube or an oscilloscope. The cathode having the heater shown in FIG. 8 operates at a heater voltage of 6.3 V and a heater current of 150 mA. When it is used as a color picture tube, the ratings are 6.3 V and 450 mA.

Figure 9:
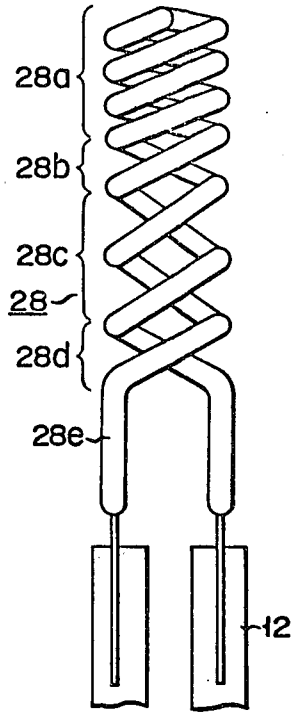
FIG. 9 is a view illustrating the heater of a quick operating type cathode according to still another embodiment of the present invention.

FIG. 9 shows the heater of a quick operating type cathode according to still another embodiment of the present invention. For example, a heater 28 shown in FIG. 9 comprises a dense pitch part 28*a*, a first intermediate pitch part 28*b*, a sparse pitch part 28*c*, a second intermediate pitch part 28*d*, and leg parts 28*e*. The reason why the first intermediate pitch part 28*b* is incorporated is that it is difficult to form the sparse pitch part directly next to the dense pitch part as in the case of the heater shown in FIG. 4 when winding the heater wire in a double helical shape. The reason why the second intermediate pitch part is incorporated is that when the leg parts 28*e* are directly formed from the sparse pitch part 28*c*, they return back to their original shape due to elasticity so that a pair of leg parts 28*e* may not be formed parallel to each other. By forming the second intermediate pitch part, a large bending angle may be secured for forming parallel leg parts 28*e*.

According to a quick operating type cathode of the present invention, the heater comprises a double helical coil which has a dense pitch part toward the side of the metal substrate and a sparse pitch part toward the side of the leg parts. The insulating material is coated thinly at the dense pitch part and thickly at the sparse pitch part. The temperature elevation characteristics of the heater are extremely good, allowing a great shortening of the image projecting time of the television set. By shortening the length of the cathode sleeve, contact between the shoulder part of the heater and the sleeve and degradation in the dielectric breakdown voltage may be prevented. Therefore, it is possible to prevent the short-circuiting between the heater and the cathode body which might otherwise be caused by the tube discharge.

What we claim is:

1. A quick operating type cathode having a cathode body consisting of: a cathode sleeve and a metal substrate which is mounted at the top opening part of the cathode sleeve and the top surface of which is coated with an electron-emissive material; and a double helical coil heater which is inserted within the cathode sleeve and the surface of which is coated with an insulating material, characterized in that said heater comprises a coil part and a pair of leg parts connected to the end part of said coil part, a dense pitch part is formed at the top portion of said coil part, a sparse pitch part is formed in said coil part at the side of the leg parts and the amount of said coated insulating material per unit length of the coil wire at said sparse pitch part is larger than that at said dense pitch part.

2. A cathode according to claim 1, wherein a first intermediate pitch part is interposed between said dense pitch part and said sparse pitch part of said coil part, and a second intermediate pitch part is interposed between said sparse pitch part and said leg parts.

3. A cathode according to claim 1 or 2, wherein the length of said coil part is greater than that of said cathode sleeve, and a shoulder part between said coil part and said leg parts is exposed from said cathode sleeve.

4. A cathode according to claim 1 or 2, wherein said double helical coil heater comprises a coiled double helical coil obtained by forming a primary coil into a double helical coil.

5. A cathode according to claim 4, wherein said leg parts comprise a primary coil, whose pitch is wider than that of a double herical coil part.

6. A cathode according to claim 1 or 2, wherein the pitch of said sparse pitch part is 1.5 to 6 times that of the dense pitch part.

* * * * *